United States Patent [19]

Papen

[11] 4,063,941

[45] Dec. 20, 1977

[54] METHOD FOR LOADING AND UNLOADING AN ISOSTATIC PRESS FOR COMPRESSION OF PRE-FORMED POWDER OBJECTS

[75] Inventor: Eduard L. J. Papen, Belsele, Belgium

[73] Assignee: National Forge Company, Irvine, Pa.

[21] Appl. No.: 747,897

[22] Filed: Dec. 6, 1976

[51] Int. Cl.[2] ..... B22F 1/00; B29D 3/00

[52] U.S. Cl. ..... 75/226; 29/420; 264/266; 425/405 H

[58] Field of Search ..... 264/266; 425/405 H, 425/78; 75/226; 29/420, 420.5; 148/11.5 P; 72/270

[56] References Cited

U.S. PATENT DOCUMENTS

| | | | |
|---|---|---|---|
| 2,449,515 | 9/1948 | Seelig | 425/78 X |
| 3,172,153 | 3/1965 | Loomis et al. | 425/405 H |
| 3,173,283 | 3/1965 | Vogtmann | 72/270 |
| 3,184,944 | 5/1965 | Sibler | 72/270 |
| 3,239,591 | 3/1966 | Wendt | 425/405 H X |
| 3,454,997 | 7/1969 | Ligon et al. | 425/405 H |
| 3,698,843 | 10/1972 | Bowle | 425/405 H |
| 3,820,934 | 6/1974 | Stigler | 425/405 H X |
| 3,956,452 | 5/1976 | Saito | 425/405 H X |

*Primary Examiner*—Leon Gilden
*Attorney, Agent, or Firm*—James D. Bock

[57] ABSTRACT

Method for loading and unloading of isostatic presses of the type wherein pre-formed, or equivalent, shapes of powdered metal, ceramics, clay and the like are compressed under very high pressures to form compacts suitable for use as such or for subsequent operations, such as forging, machining, firing or the like as may be appropriate for the particular powdered material. Method is disclosed in connection with the use of an isostatic press having a container including a cylindrical sleeve of elastomeric material for receiving the objects to be compressed under pressure of hydraulic fluid applied to exterior of the container. Bodies of rigid or elastomeric material which also may serve as plugs for the ends of the sleeve are movable from inside to outside the press to positions to receive a pre-form. Method comprises loading of a pre-form onto one of the bodies or plugs, pressing the other onto the pre-form to hold it between the bodies and then moving both bodies with the pre-form held therebetween into the press where it is held by the bodies during the compressing operation which converts the pre-form into a compact. The press is then opened and the two bodies are moved out of the press, holding the compact and placing in a position for removal from the press. Method is of particular value in handling pre-forms which are elongated and unstable when standing on end under influence of gravity alone, the bodies or plugs manipulated according to the method being effective to hold such pre-forms in upright position for loading and compressing and unloading.

6 Claims, 8 Drawing Figures

METHOD FOR LOADING AND UNLOADING AN ISOSTATIC PRESS FOR COMPRESSION OF PRE-FORMED POWDER OBJECTS

RELATED UNITED STATES APPLICATION

Application Ser. No. 747,915 filed Dec. 6, 1976 is directed to the structure of an isostatic press of a type which may be utilized in the practice of the method of the present invention.

BACKGROUND

Isostatic pressing of objects by the wet bag system involves the placing of a pre-formed object in an elastomeric bag which is then placed in the cavity of a press and the press is closed. Hydraulic fluid then is admitted to the press wetting the outside surface of the bag and as the pressure is increased the bag yields to conform to the shape of the object whereby the pressure is isostatically exerted upon the object to form it into a compact. After pressing and lowering of pressure on the hydraulic fluid the bag is removed for extraction of the compact and reloading of the bag with another pre-formed shape. This entire operation is inherently slow and involves a great amount of manual handling of the bags, pre-formed shapes and the compacts.

In contrast with this, as illustrated in U.S. Pat. Nos. 3,557,405 and 3,591,903 for example, the isostatic forming and pressing of objects directly from powder have been effectively automated being performed in multicavity presses or in single cavity presses with mechanical auxiliaries for loading the cavity or cavities with powder and extracting the pressed compacts in cyclic fashion. In devices of the latter type the cavity or cavities consist of hollow molds of specific shape for the formation of a compact having that shape when pressing is completed. Thus, in operation, the mold cavities are opened, a measured amount of powder is poured into the cavity and, after closure of the vessel, the pressing step is performed. The compact thus formed is removed by manual or automatic means either through the same opening used for filling or through an oppositely disposed opening as may be preferred or required.

In devices of the latter type the molds are formed of one or more bodies of elastomeric material having hollows therein of the specific shape required. Thus, the production is limited to that specific shape and size of compact unless a new mold or set of molds is substituted. Also, there are limitations on the types of shapes that may be formed and compacted in such devices without involving considerable complication such as making the molds in several pieces.

In this background there is need for a method useful with apparatus having the relatively great versatility of the wet bag presses to provide convenient manual and, if desired automated, loading and unloading of preformed shapes.

BRIEF DESCRIPTION OF PREFERRED EMBODIMENTS

An isostatic press of the type with which this method is useful comprises a pressure vessel having a body of generally known design for use in pressing and compacting objects under very high pressures, for example from about 40,000 p.s.i.g. to 100,000 p.s.i.g. or more. Such body is in the form of an open-ended tube made of metal of such specifications and thickness as to withstand pressures of the magnitude here involved. The open ends of the tube are internally threaded with interrupted threads to mate with interrupted threads formed on end closure members whereby the closure members may be inserted with threads in non-mating position and thereafter closed pressure-tight by turning the closures only a fraction of one complete turn, all as is well known in this art.

The tubular body of such press has positioned therein an assembly comprising an imperforate liner fitting snugly within the central bore of the body and a canister, perforated radially as is well-known or otherwise constructed to permit flow of hydraulic fluid from an annular space between the liner and the canister to the inside of the canister. An elastomeric membrane consisting of a thin-walled tubular sleeve made of rubber-like material, such as urethane, positioned within the canister. The membrane, made of such material will yield and stretch and rebound much the same as the rubber-like bags used in the wet-bag procedure. The membrane is constructed to be sealed at the opposite ends of the canister so that the hydraulic fluid which has access to the outer surface of the membrane is confined in a closed system including the openings of passageways in the canister, the annular space mentioned above and the conventional inlet and outlet passageways, valves and hydraulic pressure lines utilized in this type of apparatus.

The metallic threaded closures mentioned above each have a body such as a tapered plug of rigid or of flexible, incompressible elastomeric material, such as urethane, secured thereto in position to be forced into the respective ends of the membrane in sealing relationship whereby there is formed a container for objects to be pressed. When elastomeric plugs are used the entire inner surface of the container is defined by elastomeric material, that is, by the inner surface of the membrane and the inner surfaces of the two elastomeric plugs.

With only the description so far it will be recognized that the cavity thus takes on much the character of a conventional wet bag. That is the membrane when placed under hydraulic pressure through the canister will collapse inwardly while the end regions thereof lying over rigid plugs will conform those plugs. When elastomeric plugs are used the membrane will press inwardly on those plugs, distorting the incompressible material thereof in the direction in which such material is permitted, and forced, to flow under such pressure. In general, the membrane will tend to collapse radially of the bore of the vessel while the elastomeric plugs will tend to be reduced in diameter thus to elongate inwardly and axially of said bore.

At least one of the metal end closures with the body or plug attached thereto is preferably arranged for quick removal from and insertion into sealing position. In a preferred form of the invention disclosed and claimed in said application Ser. No. 747,915 the closure at the lower end of the pressure vessel is made removable and is mounted on the end of a vertical rod actuated by a hydraulic cylinder so that it may be removed from sealing position and lowered away from the pressure vessel for a distance sufficient to permit the positioning on the inner end of the plug of the pre-form. The closure is then raised by the hydraulic cylinder to position the pre-form in the container or cavity of the vessel whereupon the closure is locked by partial rotation.

When hydraulic fluid is now pumped into the vessel and pressure is raised the elastomeric portions of the cavity will press inwardly upon the pre-form to compress it isostatically.

When desired pressure is reached and reduced the bottom closure may be unlocked and lowered with the compact resting upon the lower plug in position to be removed.

The plug which closes the upper end of the cavity is carried on the end of a rod which is driven vertically by a hydraulic cylinder. When the vessel is pressurized the upper plug, like the lower rests against the solid metal structure of the associated end closure. During depressurization the upper plug is subjected to a downward hydraulic pressure so that the upper plug will progressively move downward to continue to press upon the upper end of the compact.

In the practice of the present method when the lower plug is lowered away the upper plug continues to be pressed downwardly so that it will follow and hold the compact firmly in position during movement of both plugs to positions outside the body of the press in which the compact may be gripped by hand or mechanical means for removal from the press after the upper plug is retracted.

In the practice of the method conveyors may be provided for supplying and taking away the pre-forms and compacts. For complete automation of the method a timer and valves operated thereby may be provided.

THE DRAWINGS

Figure 3:
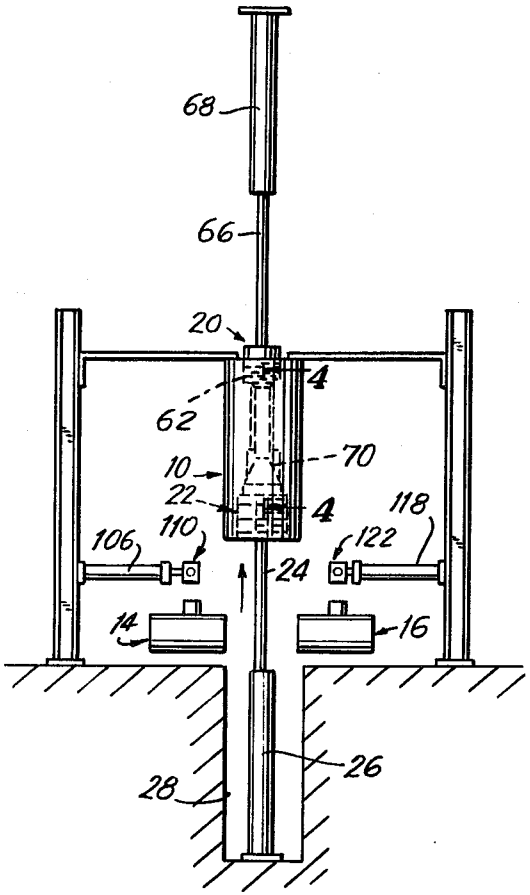
FIGS. 1, 2 and 3 are digrammatic views illustrating sequential steps in the loading of an isostatic press in accordance with the present invention.
Figure 2:
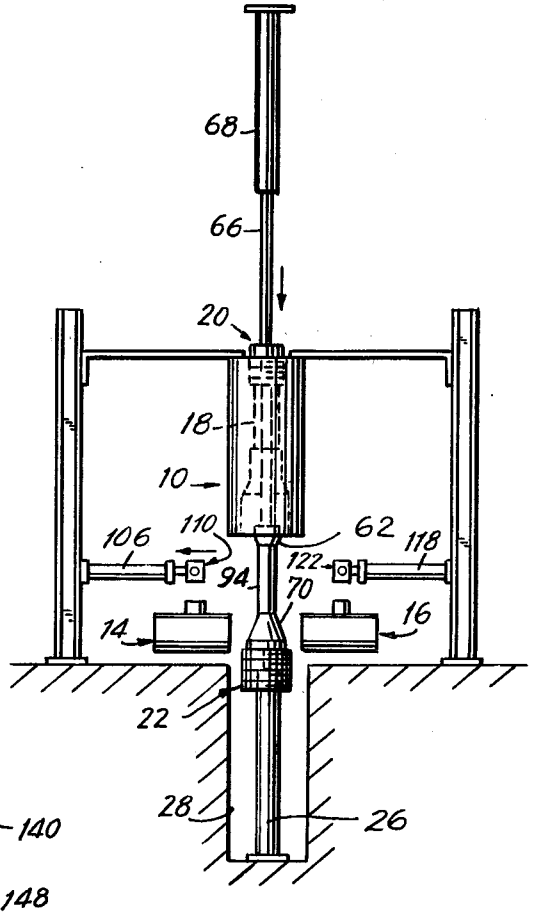
Figure 1:
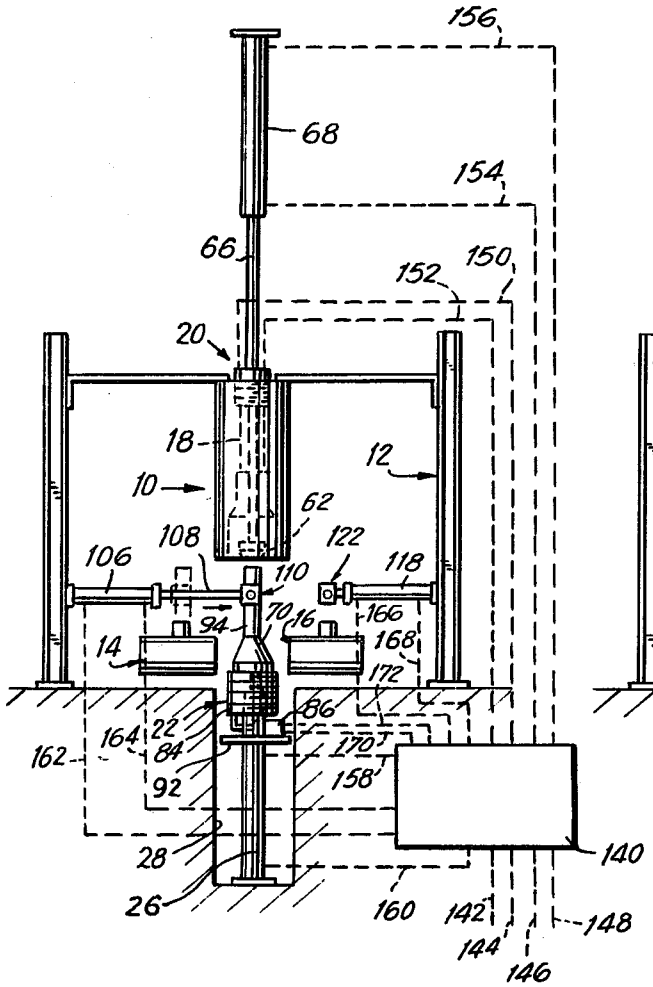
Figure 8:
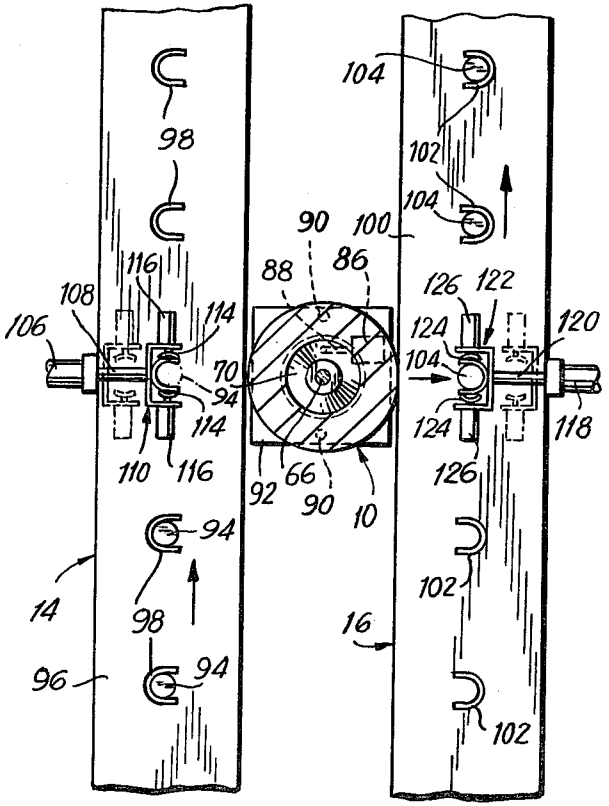
Figure 7:
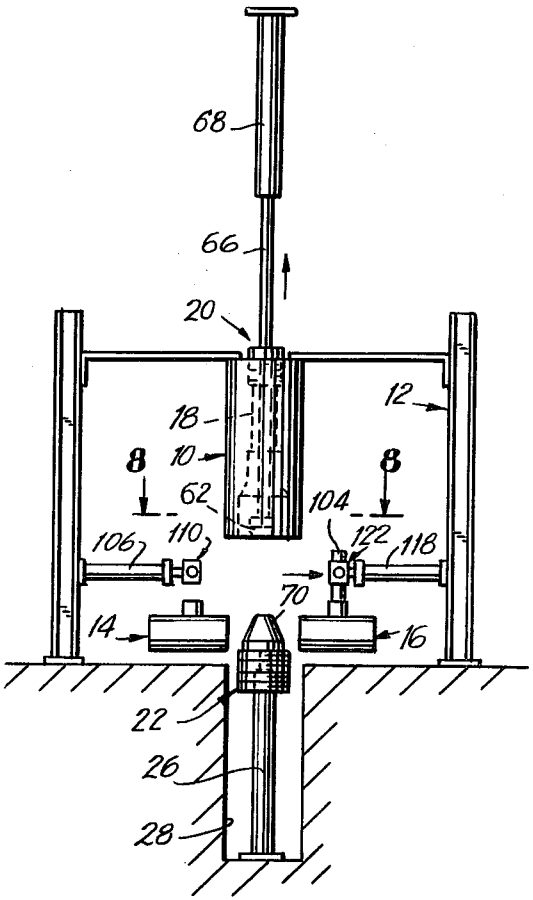
Figure 6:
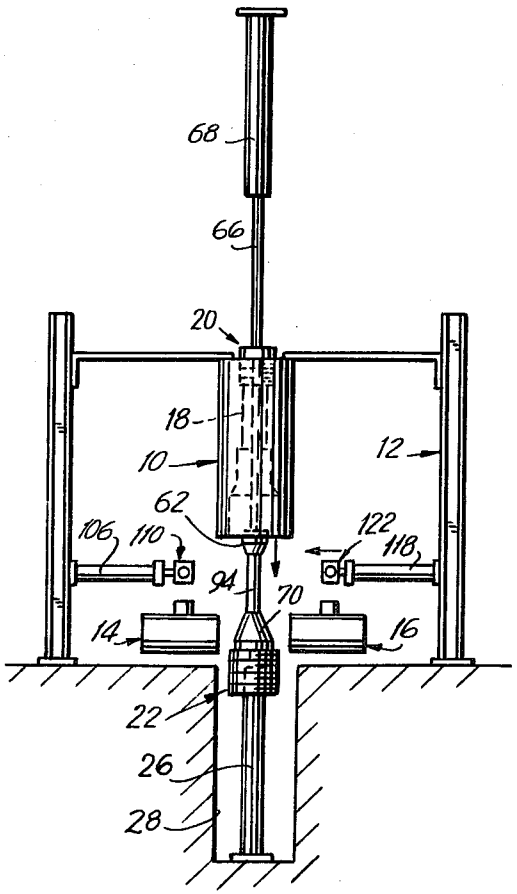

FIGS. 6 and 7 are digrammatic views similar to FIGS. 1, 2 and 3 illustrating sequential steps in unloading the press, and FIG. 8 is a digrammatic horizontal sectional view taken along the line 8—8 in FIG. 7.

DETAILED DESCRIPTION OF PREFERRED EMBODIMENTS

The present invention will be described in connection with the accompanying drawings in which the method is illustrated in connection with the compressing of pre-formed shapes (sometimes herein called "pre-forms") made of powdered materials such as metal, ceramics, clay and the like to produce compacts which may be useful as such without further treatment but which usually are adapted for further processing such as forging, heat treating, firing, machining and the like. While pre-forms of almost any shape and contour may be handled in accordance with the method embodying the present invention the invention presents advantage in the handling of elongated objects such as a cylindrical rod or other elongated objects which it is desired to insert lengthwise into the cavity of the press and which have little or no stability when standing on end under the influence of gravity alone. For illustrative purposes the present invention is diagrammatically illustrated in the handling of a cylindrical rod and a somewhat more detailed showing is made of the handling of a lever with integral hub, the handle being generally square in cross-section and the hub having a transverse circular opening.

The pre-forms with which this invention may be used may be of any customary type, for example they may be made pressing or tamping in molds from self-adhesive powdered materials or from a mixture of the desired powdered material with a binder of liquid or heat activatable adhesive or they may comprise thin plastic, paper or similar containers filled with the desired powder, the containers being made in the shape desired for the product. The latter procedure may be preferred in those instances wherein adhesive or other binding agent may be undesirable or harmful to the final product.

In FIG. 1 an isostatic press 10, supported in upright position on a frame 12 is shown in relation with a supply conveyor 14 and takeaway conveyor 16. The press 10 has a generally cylindrical fluid pressure chamber 18 closed at the top by a closure 20. A lower closure 22 is mounted on the piston rod 24 (see FIG. 3) of a double acting hydraulic cylinder 26 fixed in a pit 28. As will be explained below the lower closure 22 is thus arranged to be lowered away from the press 10 to a loading position shown in FIGS. 1 and 2 and to be raised to closing position as shown in FIG. 3. Also, when moved to closing position the lower closure 22 is rotated into locking position whereupon hydraulic fluid is pumped into the fluid pressure chamber to compress a pre-formed object positioned therein.

Figure 4:
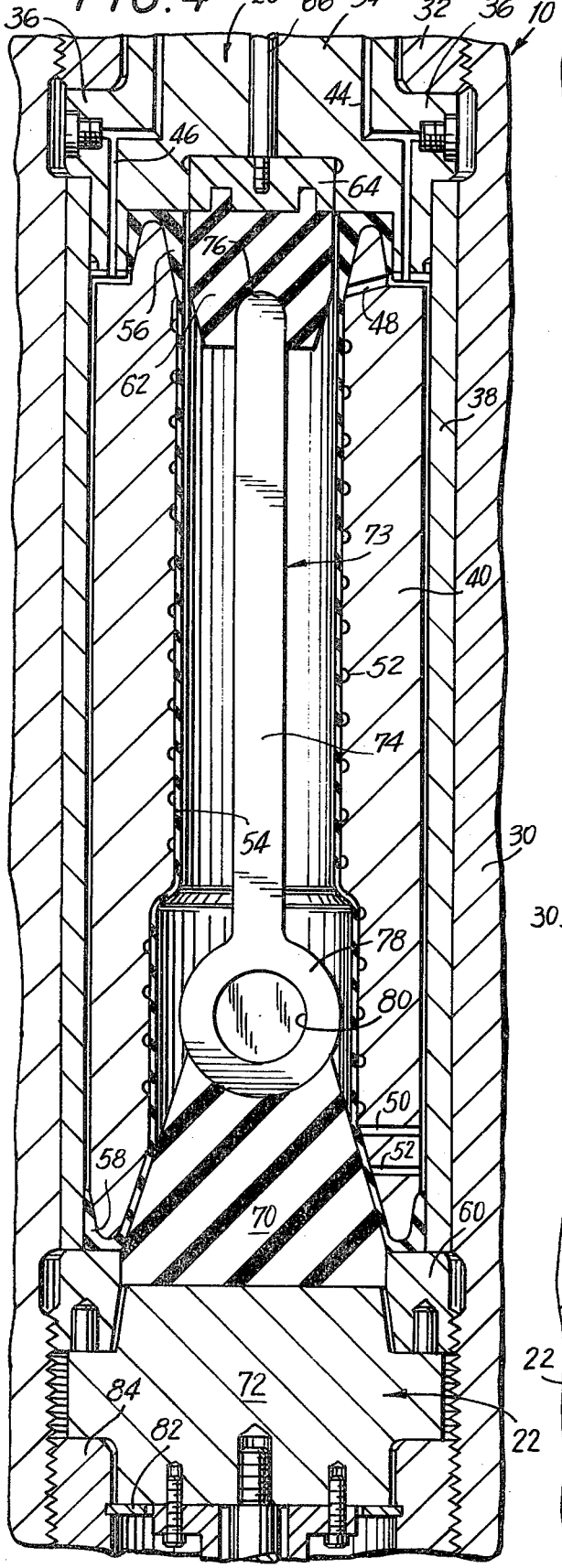
FIG. 4 is a vertical sectional view of an isostatic press of the type suitable for use in the practice of the present invention, the press being shown in unpressurized condition.
Figure 5:
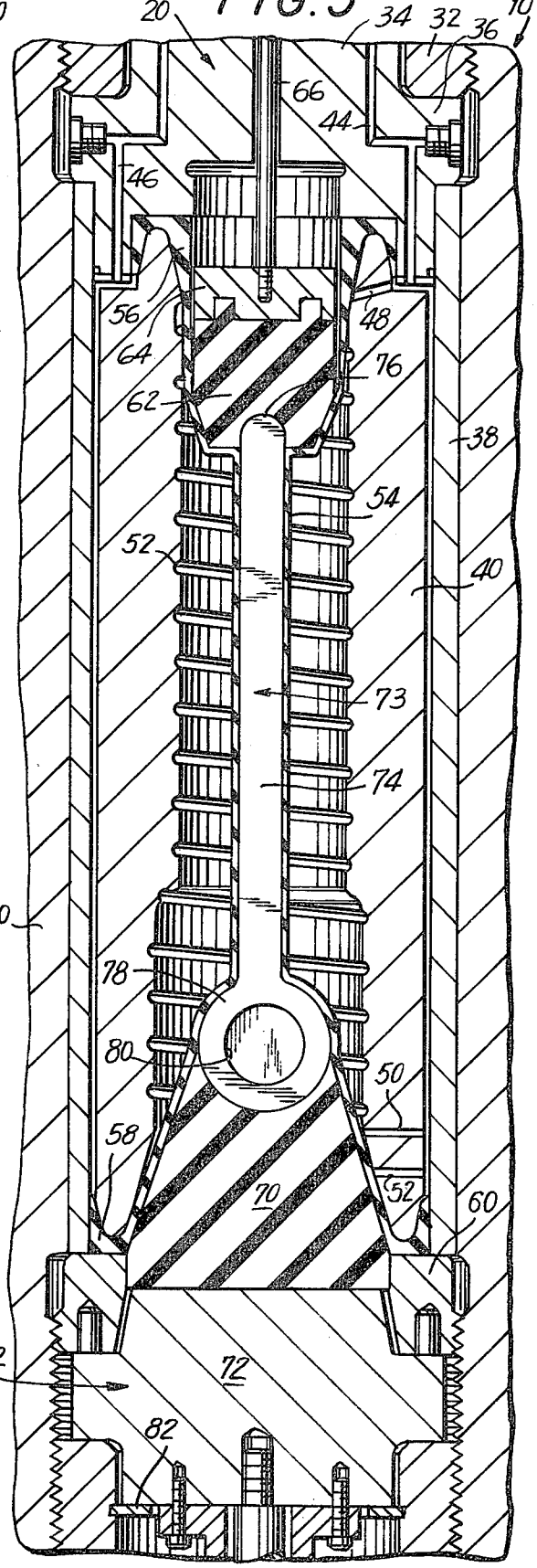
FIG. 5 is a view similar to FIG. 4 but showing the press in pressurized condition assumed in performing the step of compacting of a pre-form loaded into the press.

Referring now to FIGS. 4 and 5 there is shown a form of isostatic press with which the method of the present invention may be practiced. The structure of the press 10 shown in FIGS. 4 and 5 forms the subject matter of said copending application s.n. As shown in these FIGS. 4 and 5 the press 10 includes a body 30 comprising a thick rigid metal cylinder open at both ends and having interior threads for reception of the upper and lower closures 20 and 22 respectively. The upper closure 20 is threaded into closing position upon assembly of the press 10 and remains in that position until disassembly is required. The upper closure 20 comprises a threaded tubular sleeve 32, mated with interior threads in body 30, which surrounds a heavy metal closure body 34 having an annular flange 36 against which the tubular sleeve 32 presses to hold the body 34 in pressure tight position in the press. The interior of the press 10 includes a liner sleeve 38 having a predetermined inner diameter and within is positioned a perforated canister 40 having an outer diameter somewhat less than the inner diameter of liner sleeve 38. This leaves an annular space 42 between liner sleeve 38 and canister 40 for flow of hydraulic fluid from passageways 44 and 46 which extend through the upper closure body 34 and open into the space 42. Pressurized hydraulic fluid therefore may be pumped from a suitable hydraulic pump (not shown) through one of the passageways 44 or 46 to space 42. The other passageway 44 or 46 may be left open briefly for bleeding of air, where required, after which it is closed and continued admission of fluid will be effective to raise fluid pressure within the press 10 to the very high levels, for example from about 40,000 p.s.i.g. to 100,000 p.s.i.g. or more, normally utilized in this art.

The perforated canister 40 may be provided with a large number of radial openings as is common in this art (see patent 3,537,405 FIG. 4, for example). However as shown herein there are only a few radially extending passageways 48, 50 and 52 for example which open into the interior of canister 40 and into the space 42. As shown most clearly in FIG. 5 these passageways communicate directly or indirectly with a continuous helical passageway 52 extending from end to end of the interior of canister 40. The helical passageway 52 may be in the form of a semi-circular groove formed in the inner wall of canister 40.

A membrane 54 made of elastomeric material which is flexible and will stretch and recover, urethane for example, is positioned within the canister 40. The membrane 54 is in the form of a sleeve having a relatively thin wall of generally cylindrical shape and having integrally formed sealing flanges 56 and 58 at opposite ends thereof which fit over the ends of canister 40. At the upper end of membrane 54 the flange 56 fits over the upper end of canister 40 and also is positioned to seal against the upper closure body 34 to make the upper end of the fluid pressure chamber leak proof. At the lower end of membrane 54 the flange 58 fits over the lower end of canister 40 and into the space 42. The flange 58 also is sealed by a washer 60 threaded into the body 30. In this manner the lower portion of the fluid pressure chamber of the vessel is made leak proof. The hydraulic fluid is thus confined to regions exterior of the membrane 54 and within the canister 40 and the space 42 for communication with the supply passageways 44 and 46 in the upper closure. Hydraulic pressure exerted within this confined region will tend to collapse the membrane 54 upon an object that may be placed therein. The membrane 54 is open at both opposite ends and in order to close the upper end there is provided a plug 62, made of an incompressible elastomeric material such as urethane, which is fixed upon a metal disc 64. Disc 64 seats in a recess in the upper closure body 34 and is connected to the lower end of a piston rod 66 which extends through body 34 and upwardly, see FIG. 1, to a double acting hydraulic cylinder 68. The outside of disc 64 and the maximum outside diameter of elastomeric plug 62 is such as to move freely downwardly through the interior of membrane 54 when the pressure vessel is unpressurized as shown in FIG. 4.

At the lower end of membrane 54 the open end thereof is adapted to be closed and opened at will by an elastomeric plug 70 made of an incompressible material such as urethane secured to the heavy rigid body 72 of the lower closure 22. The plug 70 is tapered to fit snugly into the portion of membrane 54 which flares outwardly with the contour of the lower end of canister 40 when the lower closure 22 is in closed position shown in FIG. 4.

The membrane 54, upper elastomeric plug 62 and lower elastomeric plug 70 thus define a wholly elastomeric container within which a pre-form may be positioned for compression without coming in contact with the pressurized hydraulic fluid. The container thus formed is comparable in function to the elastomeric bag customarily used in the well-known wet bag process utilized in isostatic presses for handling pre-form objects of almost any shape.

In FIG. 5 the press is shown in pressurized condition wherein the membrane 54 is collapsed upon a pre-form and upon the plugs 62 and 70. The pre-form 73 shown in FIGS. 4 and 5 is typical of the shapes for which this method is intended, and consists of a lever with an integral hub. The handle portion 74 of the lever may be square in cross-section, for example and may terminate in a rounded end 76. The hub 78 of the lever may be circular in outline and be provided with an opening 80 extending transversely of the axis of the handle 74. With a pre-form such as this the inner contour of canister 40 and membrane 54 may be shaped to correspond roughly with the general shape of the pre-form. Thus in FIGS. 4 and 5 it will be observed that the inner diameter of the membrane 54 is smaller in the region of handle 74 and is larger in the region of the hub 78. This can be done inasmuch as the present invention provides for the loading and unloading of pre-forms from the lower end of the press.

In the unpressurized condition shown in FIG. 4 the preform 73 is supported at the lower end upon the plug 70 and is engaged at the upper end with plug 62 thus to be firmly held in upright position in the container comprising membrane 54 and plugs 70 and 62. As will be disclosed hereinbelow holding of the pre-form 73 in upright position forms a part of the method of the present invention. When the press is pressurized the membrane 54 is progressively collapsed into firm engagement with all surfaces of the pre-form 73 and with the outer surfaces of elastomeric plugs 62 and 70. Under high pressure the pre-form is compressed by the membrane 54 and also by the distortion of plugs 62 and 70 axially of the fluid pressure chamber and of the pre-form 73. The pressure thus applied axially to the pre-form 73 will compress the pre-form lengthwise.

When the pressure is reduced in the pressure chamber hydraulic pressure is exerted by the upper cylinder 68 to force the upper plug 76 downwardly as permitted by progressive relaxation of the membrane 54. In this manner the upper plug maintains vertical pressure upon the now compacted pre-form 73 as the plugs 62 and 70 progressively return to the unpressurized shape shown in FIG. 4. If desired the pressure outside the membrane 54 may be lowered below that in the interior thereof thus to firmly hold the membrane in contact with the inner surfaces of canister 40.

The lower closure 22 now may be removed for unloading of the compacted pre-form 73. The lower closure 22 may be of the form disclosed in said copending application Ser. No. 747,915. In that event the body 72 of closure 22 is connected by a spring washer 82 to a threaded sleeve 84 received in the lower end of the press body 30. Preferably the threads on sleeve 84 and within body 30 are interrupted threads such as shown in patent 3,730,666, FIG. 6 so that the closure 22 may be inserted linearally into the opening almost to closed position and thereafter locked in closed position by rotation of sleeve 84 through a small fraction of one complete turn. A hydraulically operated means for causing such rotation is provided and shown diagrammatically in FIG. 8. Such hydraulic means is very similar to that shown in said patent 3,730,666, FIG. 4 and comprises a double acting hydraulic actuator 86 having a piston rod 88 connected by a pin (not shown) with threaded sleeve 84. The actuator 86 is mounted on a cross-member 92 slidably carried on spaced vertical rods 90 and fixed for upward and downward movement with the lower closure 22. The actuator 86 is operated at proper timed intervals to cause the partial rotation of sleeve 84 required for locking and unlocking the closure 22.

The location of hydraulic actuator 86 and the cross-member 92 on which it is mounted is also diagrammatically shown in FIG. 1, it being understood that these parts move vertically with the lower closure 22 as described above. As a result the actuator 86 remains continuously in operative engagement with the threaded sleeve 84 for partial rotation of the latter between locking and unlocking positions when required.

As noted above FIGS. 1, 2, 3, 6, 7 and 8 illustrate the method of the present invention in connection with the loading of a pre-form and unloading of a compact, consisting of the pre-form after compression in the isostatic press, wherein the pre-form is a relatively tall slim cylinder or rod. It will be apparent that the handling of such a pre-form is entirely comparable with the handling of the particular pre-form 73 shown in FIGS. 4 and 5 insofar as the method is concerned.

Referring now to FIGS. 1 and 8 a series of cylindrically shaped pre-forms 94 is brought up to one side of the press 10 by the supply conveyor 14 which may comprise an endless belt 96 having longitudinally spaced holders such as spring clips 98 secured thereto in position to hold the pre-forms 94 temporarily in upright position as they approach the press 10. The takeaway conveyor 16 is positioned on the opposite side of the press 10 and may comprise an endless belt 100 having longitudinally spaced holders such as spring clips 102 secured thereto for receiving and temporarily holding the compacts 104 upright as they are moved away from the press by movement of belt 100. It should be noted that since the compacts 104 will be smaller in size than the pre-forms 94 and the clips or other holders 102 may be appropriately different in size or design from the clips 98 on supply conveyor 14.

As shown in FIGS. 1 and 8 article gripping and transferring devices are provided for moving the pre-forms 94 from conveyor 14 to a position for loading into press 10 and for engaging and removing the compacts 104 from the press and positioning them on the takeaway conveyor 16. Illustratively, the device for loading may comprise a double acting hydraulic cylinder 106 having a piston rod 108 which carries a gripping device 110 on the outer end of rod 108. The gripping device 110 is movable from a retracted position out of the way of incoming pre-forms 94 on conveyor 14 (shown in broken lines in FIG. 8) into a position for engagement with a pre-form 94 which has been brought to a position in lateral alignment with the centerline of the press 10. The gripping device 110 illustratively may comprise a yoke 112 secured to piston rod 108 and carrying a pair of opposed gripping shoes 114 actuated by hydraulic pistons, solenoids or the like 116 to close upon the pre-form 94 when the yoke 112 moves into the position shown in full lines in FIG. 8. Continued movement of the piston rod will be effective to transport pre-form 94 into coincidence with the centerline of press 10 as shown in FIG. 1.

A similar article gripping and transferring device is provided for unloading the compacts 104. This comprises a double acting hydraulic cylinder 118 with a piston rod 120 carrying a gripping device 122, gripping shoes 124 and actuators 126 all as described above in connection with the loading device.

In FIG. 1 the loading gripping device 110 has moved a pre-form 94 to loading position resting upon the lower elastomeric plug 70 and is holding the pre-form 94 upright. The upper elastomeric plug 62 at this time remains positioned above the upper end of pre-form 94 where it has not interfered with movement of pre-form 94 into the FIG. 1 position. Immediately thereafter the upper elastomeric plug 62 is moved downwardly to press vertically upon pre-form 94 after which the gripping device 110 may be released and moved back to the position shown in FIG. 2. Next, the hydraulic piston is energized to raise the lower closure 22 and hydraulic pressure on the upper elastomeric plug is overcome or relieved whereby the pre-form 94 firmly held by vertical pressure between the plugs 70 and 62 is raised into the fluid chamber 18 of the press 10. When the parts reach the position shown in FIG. 3 the hydraulic activator 86 (FIGS. 1 and 8) is energized to lock the lower closure by partial rotation of threaded sleeve 84.

The pre-form 94 is now in position to be compacted as has been described above in connection with the pre-form 73 and FIGS. 4 and 5. After compaction hydraulic pressure is exerted on upper elastomeric plug 62 to maintain it in contact with the upper end of the compact as the compacting pressure in the press is lowered. The pre-form 94, now identified as a compact 104 is ready to be unloaded as shown in FIGS. 6 and 7.

In FIG. 6 the lower closure 22 has been unlocked and the hydraulic pressure on upper elastomeric plug 62 is maintained as the lower closure 22 is lowered, thus the grip the compact 104 and hold it upright as shown in FIG. 6. The gripping device 122 is now moved toward the left as viewed in FIG. 6 to grip the compact 104, the upper elastomeric plug is then moved upwardly out of engagement with the compact. The gripping device 122 is now moved by cylinder 118 to the position shown in FIG. 7 thus to engage the compact 104 in one of the spring clips 102 on conveyor 16. The gripping device is then released by energization of actuators 126 and continues to move to the broken line position in FIG. 8 to permit the takeaway conveyor 16 to advance the compact 104 towards a station (not shown) for unloading of the conveyor 16.

As will be apparent the method hereinabove described may be performed manually by operation in predetermined timing and sequence of a plurality hydraulic valves, electrical controls and the like. However, for achievement of maximum production speed and economical utilization of hydraulic pumping equipment, particularly of the very high pressure hydraulic pumps which supply the fluid pressure chamber of press 10, it is preferred to provide an automatically timed control device for operating the equipment in a precisely established program. Such devices are well known and available in many specific forms and the selection of suitable equipment for use in the present invention will be made obvious upon consideration of the diagrammatic showing thereof in FIG. 1. Thus, a control box 140 is shown which contains a timer and a plurality of valves of on-off and throttling types as required actuated by the timer in the desired sequence. A pair of hydraulic lines 142, 144 connects box 140 with a high pressure hydraulic pump for supplying fluid to the fluid pressure chamber 18 of press 10 and a pair of hydraulic lines 146, 148 connects box 140 with a lower pressure hydraulic pump for supplying fluid to the various cylinders and actuators in the system. These supply lines are connected internally of box 140 with the valves aforesaid which distribute fluid as required through hydraulic lines to the various components of the press described above. Thus, a pair of lines 150, 152 connect box 140 with the fluid pressure chamber 18 to supply the high pressure hydraulic fluid thereto when and as required. A pair of lines 154, 156 connects box 140 with the opposite ends of upper hydraulic cylinder 68 for supply and control of pressurized low pressure fluid to raise and lower the upper elastomeric plug 62 and a similar pair of lines 158, 160 connect box 140 with the lower hydraulic cylinder 26. A pair of lines 162, 164 connects box 140 with the opposite ends of cylinder 106 and a similar pair of lines 166, 168 connects box 140 with the opposite ends of cylinder 118 for supply of low pressure hydraulic fluid to cylinders 106 and 118. A pair of lines 170, 172 connects box 140 with the locking and unlocking actuator 86 for supply of low pressure hydraulic fluid to that actuator. Additional hydraulic lines or electrical cables (not shown) may be provided for control of the article gripping shoes in the gripping devices 110 and 122 (see FIG. 8).

The supply conveyor 14 and takeaway conveyor 16 also must be operated in proper timed relation with the operation of the loading cylinder 106 and unloading cylinder 118. This may be accomplished manually by operation of a switch (not shown) to effect movement of the conveyor 14 to present a pre-form in proper position before the loading cylinder 106 is effective to transfer the pre-form from the conveyor to the position shown in FIG. 1. The unloading conveyor 16 may be similarly manually energized to present an empty clip 102 in proper position before the cylinder 118 is effective to transfer a compact 104 from the FIG. 6 position to the FIG. 7 position.

When automatic operation is utilized suitable switches will be provided in box 140 (FIG. 1) and operated by the timer therein to move the conveyors 14 and 16 by increments at appropriate times. Alternatively, in automatic operation the conveyors 14 and 16 may be continuously driven at a speed precisely synchronized with the timer in box 140 whereby to present a pre-form 94 on conveyor 14 or an empty clip 102 on conveyor 16 at the proper time with relation to performance of the loading and unloading steps.

For economic reasons it may be preferred to provide two or more complete isostatic presses of the type utilized herein to share the services of a single source of high pressure hydraulic fluid. In such event the timers in the boxes 140 of each press will be interlocked in such manner that while one press is loading and unloading the other is in that portion of its cycle wherein high pressure fluid is being supplied to the fluid pressure chamber thereof. In this connection it will be appreciated that a substantial portion of the complete cycle of each press is devoted to depressurizing of the fluid pressure chamber, unlocking and lowering of the lower closure 22, transfer of the compact 104 to the takeaway conveyor, transfer of a pre-form 94 to loading position, raising of the pre-form 94 into the fluid pressure chamber 18 and locking of the lower closure 22. If the time required for these loading and unloading operations is somewhat more than one-half of the total cycle the high pressure hydraulic source may be utilized for pressurization of one additional press having a similar time cycle and interlocked for operation in opposite phase. If the time required for loading and unloading constitutes a substantially greater fraction of the total time cycle a proportionately greater number of presses may be interlocked for properly phased operation. Obviously also the time required for loading and unloading may be deliberately stretched somewhat to permit operation of one or more additional presses from a single source of high pressure hydraulic fluid, in any instance wherein the slightly reduced total output of compacts from each press would be offset by the obviously more efficient utilization of the costly, and high energy consuming source of high pressure hydraulic fluid.

While the isostatic press chosen for illustration herein to be utilized in practice of the method of the present invention has been shown as an upright, bottom loading press it will be apparent that the method is equally useful in connection with a top loading press of the same general type or a horizontally disposed press of the same general type which loads from either of its ends. For example the press 10 shown herein could be bodily inverted to load and unload at the top by use of conveyors and transfer devices identical with the conveyors and transfer devices shown herein. Also, with some obvious modification of the conveyors the press 10 could be laid on its side to be loaded and unloaded from either end. The important point here is that the present method provides positive engagement with and control of the pre-forms and compacts at all times whereby gravity plays no part in the positioning or movement thereof.

The foregoing detailed description has been made in connection with the utilization of a press wherein the plugs 70 and 62 are made of elastomeric material. As is the case in said copending application Ser. No. 747,915 the plugs may be made of rigid material such as metal or they may be bodies capable of engaging and holding the pre-form or compact without necessarily performing the function of closing the opposite ends of the membrane or sleeve 54. When rigid plugs or bodies are thus used the method of loading and unloading is substantially unaffected. However, inasmuch as rigid plugs, of shape such as 70 and 62, will not be distorted when pressure is applied to membrane 54 the latter will conform to the shape of the plugs and will collapse upon the pre-formed object held therebetween. The resultant compressing of the pre-form will not reduce the lengthwise dimension thereof but rather will force the opposite ends of the pre-form against the unyielding surfaces of the rigid plugs. The pre-form will thus be compressed in all directions including lengthwise but without change in length.

When rigid plugs or bodies are used instead of the elastomeric plugs 62 and 70 the upper plug corresponding with 62 will remain in continuous contact with the upper end of the pre-form whereby, when the unloading steps are initiated it is not necessary to apply hydraulic pressure to the plug to make it compensate for lengthwise shrinking of the compact and recovery of shape of an elastomeric plug. However, hydraulic pressure will be applied to the upper rigid plug to make it follow the compact as it is withdrawn from the press thus to insure that at all times the compact is held by lengthwise or axial pressure between the upper and lower plugs. While this pressure is unyielding it is the full equivalent, insofar as the method is concerned, of the yielding pressure which is exerted upon the preform or compact by elastomeric plugs.

What is claimed is:

1. In a method for compacting pre-formed objects made of powdered material in an isostatic press having a fluid pressure chamber, a generally cylindrical container within said chamber for receiving an object inserted along the cylindrical axis of said container, said fluid pressure chamber and said container being closed at one end by first closure means including a first plug extending into said container adapted when the press is in unpressurized condition to be moved axially through said container to and beyond the opposite end thereof, second closure means for closing the opposite end of said fluid pressure chamber and said container including a second plug extending inwardly of said container, and said second closure means being removable by axial movement away from said container when the press is in unpressurized position to open said opposite end of said container and to position said second plug in axial alignment with and spaced from said container, the improvement which comprises the steps of opening said opposite end of said container by moving said closure means axially of and away from said container, placing a pre-formed object in a position outside said opposite opened end of said container aligned with the axis of said container and with one surface of said pre-formed object in engagement with the removed second plug, moving said first plug axially beyond said opposite opened end of said container to engage and press against a surface of said pre-formed object opposed to said one surface thus to hold said pre-formed object between said first and second plugs by pressure exerted in a direction which is axial of said container, moving both said plugs with said pre-formed object held therebetween axially of and into said container to position said pre-formed object therein for isostatic compression, pressurizing said press to compress and convert said pre-formed object in said container into a compact, depressurizing said press, opening said opposite end of said container by moving said second closure means away from said container while simultaneously moving said first plug axially through said container to maintain said compact held between said first and second plugs, continuing movement of said first and second plugs, with said compact held therebetween to a position outside of and axially aligned with said container, retracting said first plug axially of said container to release engagement of said first plug with said compact, and removing said compact from said press.

2. In a method for compacting pre-formed objects made of powdered material in an isostatic press having a fluid pressure chamber, a generally cylindrical container within said chamber for receiving an elongate pre-formed object inserted lengthwise along the axis of said container, said container being closed at one end by first closure means including a first plug extending into said container and adapted when the press is in pressurized condition to close said one end of said container and adapted when the press is in unpressurized condition to be moved axially through said container, said container being closed at the other end by a second closure means including a second plug extending inwardly of said container and removable by axial movement away from said container when the press is in unpressurized position to open said other end of said container, the improvement which comprises the steps of opening said other end of said container by moving said closure means axially of and away from said container, gripping a pre-formed object and transferring said gripped pre-formed object to a position outside the open end of said container with the lengthwise dimension of said pre-formed object aligned with the axis of said container with one end of said pre-formed object in engagement with the removed second plug, moving said first plug axially beyond said opened other end of said container to engage and press the same against the other end of said preformed object to hold said preformed object between said first and second plugs by pressure exerted in the direction of the lengthwise dimension of said pre-formed object, moving both said plugs with said pre-formed object held therebetween axially of and into said container to position said preformed object therein for isostatic compression and to close said other end of said container, pressurizing said press by supplying pressurized hydraulic fluid to said fluid pressure chamber to convert said pre-formed object into a compact, depressurizing said press, opening said other end of said container by moving said second closure means away from said container while simultaneously moving said first plug through said container to maintain said compact held between said first and second plugs, continuing movement of said first and second plugs with said compact held therebetween to a position outside of and axially aligned with said container, gripping said compact while it remains held between said first and second plugs, retracting said first elastomeric plug axially of said container and out of engagement with said compact, and transferring said gripped compact to a position offset from said axis of said container.

3. In a method for compacting pre-formed objects made of powdered material in an isostatic press having a fluid pressure chamber, a generally cylindrical container within said chamber for receiving an elongate pre-formed object inserted lengthwise along the axis of said container, said container being closed at one end by first closure means including a first plug extending into said container and adapted when the press is in pressurized condition to close said one end of said container and adapted when said press is in unpressurized condition to be moved axially through said container, said container being closed at the other end by a second closure means including a second plug extending inwardly of said container and removable by axial movement away from said container when the press is in unpressurized position to open said other end of said container, the improvement which comprises the steps of opening said other end of said container by moving said closure means axially of and away from said container, conveying an elongate pre-formed object with the lengthwise dimension thereof held parallel with the axis of said container to a predetermined position offset from said axis, gripping said pre-formed object and while maintaining said lengthwise dimension thereof parallel with the axis of said container transferring said gripped pre-formed object to a position outside the open end of said container and with said lengthwise dimension of said pre-formed object aligned with the axis of said container and with one end of said preformed object in engagement with the removed second plug, moving said first plug axially beyond said other end of said container to engage and press the same against the other end of said pre-formed object to hold said pre-formed object between said first and second plugs by pressure exerted in the direction of said lengthwise dimension of said pre-formed object, moving both said plugs with said pre-formed object held therebetween axially of and into said container to position said pre-formed object therein for isostatic compression and to close said other end of said container, pressurizing said press by supplying pressurized hydraulic fluid to said fluid pressure chamber to convert said pre-formed object into a compact, depressurizing said press, opening said other end of said container by moving said second closure means away from said container while simultaneously moving said first plug through said container to maintain said compact held between said first and second plugs, continuing movement of said first and second plugs with said compact held therebetween to a position outside of and axially aligned with said container, gripping said compact while it remains held between said first and second plugs, retracting said first plug axially of said container and out of engagement with said compact, and while maintaining the lengthwise dimension of said compact parallel with the axis of said container transferring said compact to a position offset from said axis of said container.

4. In a method for compacting pre-formed objects made of powdered material in an isostatic press having a fluid pressure chamber, a generally cylindrical container within said chamber for receiving an object inserted along the cylindrical axis of said container, said fluid pressure chamber and said container being closed at one end by first closure means including a first elastomeric body extending into said container adapted when the press is in unpressurized condition to be moved axially through said container to and beyond the opposite end thereof, second closure means for closing the opposite end of said fluid pressure chamber and said container including a second elastomeric body extending inwardly of said container, and said second closure means being removable by axial movement away from said container when the press is in unpressurized position to open said opposite end of said container and to position said second elastomeric body in axial alignment with and spaced from said container, the improvement which comprises the steps of opening said opposite end of said container by moving said closure means axially of and away from said container, placing a pre-formed object in a position outside the opened opposite end of said container aligned with the axis thereof and with one surface of said pre-formed object in engagement with the removed second elastomeric body, moving said first elastomeric body axially beyond said opened opposite end of said container to engage and press against a surface of said pre-formed object opposed to said one surface thus to yieldingly hold said pre-formed object between said first and second elastomeric bodies by pressure exerted in a direction which is axial of said container, moving both said elastomeric bodies with said pre-formed object yieldingly held therebetween axially of and into said container to position said pre-formed object therein for isostatic compression, pressurizing said press to compress and convert said pre-formed object in said container into a compact, depressurizing said press, opening said opposite end of said container by moving said second closure means away from said container while simultaneously moving said first elastomeric body axially through said container to maintain said compact yieldingly held between said first and second elastomeric bodies, continuing movement of said first and second elastomeric bodies with said compact held therebetween to a position outside of and axially aligned with said container, retracting said first elastomeric body axially of said container to release engagement of said first elastomeric body with said compact, and removing said compact from said press.

5. In a method for compacting pre-formed objects made of powdered material in an isostatic press having a fluid pressure chamber, a generally cylindrical container within said chamber for receiving an elongate pre-formed object inserted lengthwise along the axis of said container, said container being closed at one end by first closure means including a first elastomeric plug extending into said container and adapted when the press is in pressurized condition to close said one end of said container and adapted when the press is in unpressurized condition to be moved axially through said container, said container being closed at the other end by a second closure means including a second elastomeric plug extending inwardly of said container and removable by axial movement away from said container when the press is in unpressurized position to open said other end of said container, the improvement which comprises the steps of opening said other end of said container by moving said closure means axially of and away from said container, gripping a pre-formed object and transferring said gripped pre-formed object to a position outside the opened other end of said container with the lengthwise dimension of said pre-formed object aligned with the axis of said container with one end of said pre-formed object in engagement with the removed second elastomeric plug, moving said first elastomeric plug axially beyond said opened other end of said container to engage and press the same against the other end of said pre-formed object to yieldingly hold said pre-formed object between said first and second elastomeric plugs by pressure exerted in the direction of the lengthwise dimension of said pre-formed object, moving both said elastomeric plugs with said pre-formed object yieldingly held therebetween axially of and into said container to position said pre-formed object therein for isostatic compression and to close said other end of said container, pressurizing said press by supplying pressurized hydraulic fluid to said fluid pressure chamber to convert said pre-formed object into a compact, depressurizing said press, opening said other end of said container by moving said second closure means away from said container while simultaneously moving said first elastomeric plug through said container to maintain said compact yieldingly held between said first and second elastomeric plugs, continuing movement of said first and second elastomeric plugs with said compact held therebetween to a position outside of and axially aligned with said container, gripping said compact while it remains held between said first and second elastomeric plugs, retracting said first elastomeric plug axially of said container and out of engagement with said compact, and transferring said compact to a position offset from said axis of said container.

6. In a method for compacting pre-formed objects made of powdered material in an isostatic press having a fluid pressure chamber, a generally cylindrical container within said chamber for receiving an elongate pre-formed object inserted lengthwise along the axis of said container, said container being closed at one end by first closure means including a first elastomeric plug extending into said container and adapted when the press is in pressurized condition to close said one end of said container and adapted when said press is in unpressurized condition to be moved axially through said container, said container being closed at the other end by a second closure means including a second elastomeric plug extending inwardly of said container and removable by axial movement away from said container when the press is in unpressurized position to open said other end of said container, the improvement which comprises the steps of opening said other end of said container by moving said closure means axially of and away from said container, conveying an elongate pre-formed object with the lengthwise dimension thereof held parallel with the axis of said container to a predetermined position offset from said axis, gripping said pre-formed object and while maintaining said lengthwise dimension thereof parallel with the axis of said container transferring said gripped pre-formed object to a position outside the opened other end of said container and with said lengthwise dimension of said pre-formed object aligned with the axis of said container and with one end of said pre-formed object in engagement with the removed second elastomeric plug, moving said first elastomeric plug axially beyond said opened other end of said container to press the same against the other end of said pre-formed object to yieldingly hold said pre-formed object between said first and second elastomeric plugs by pressure exerted in the direction of said lengthwise dimension of said pre-formed object moving both said elastomeric plugs with said pre-formed object yieldingly held therebetween axially of and into said container to position said pre-formed object therein for isostatic compression and to close said other end of said container, pressurizing said press by supplying pressurized hydraulic fluid to said fluid pressure chamber to convert said pre-formed object into a compact, depressurizing said press, opening said other end of said container by moving said second closure means away from said container while simultaneously moving said first elastomeric plug through said container to maintain said compact yieldingly held between said first and second elastomeric plugs, continuing movement of said first and second elastomeric plugs with said compact held therebetween to a position outside of and axially aligned with said container, gripping said compact while it remains held between said first and second elastomeric plugs, retracting said first elastomeric plug axially of said container and out of engagement with said compact, and while maintaining the lengthwise dimension of said compact parallel with the axis of said container transferring said compact to a position offset from said axis of said container.

* * * * *